United States Patent [19]

Couperus

[11] 4,383,651

[45] May 17, 1983

[54] PORTABLE CRUSHING AND SCREENING PLANT

[75] Inventor: Egbert Couperus, Belleville, Canada

[73] Assignee: Allis-Chalmers Corporation, Milwaukee, Wis.

[21] Appl. No.: 198,930

[22] Filed: Oct. 20, 1980

[51] Int. Cl.[3] ..... B02C 23/00

[52] U.S. Cl. ..... 241/81; 241/101.7

[58] Field of Search ..... 241/78, 81, 101 R, 101.2, 241/101.7; 198/605

[56] References Cited

U.S. PATENT DOCUMENTS

| | | | |
|---|---|---|---|
| 2,593,353 | 4/1952 | Shelton, Jr. | 241/81 X |
| 3,203,652 | 8/1965 | Poynter | 241/101.7 X |
| 3,439,806 | 4/1969 | Kass et al. | |
| 3,805,946 | 4/1974 | Yateman et al. | 198/165 |

*Primary Examiner*—Mark Rosenbaum
*Assistant Examiner*—Timothy V. Eley
*Attorney, Agent, or Firm*—Charles L. Schwab

[57] ABSTRACT

A mobile, portable crushing and screening plant includes a crusher (17), a screening device (31), and a conveyor (46) mounted on the trailer having a main frame (11) and support wheels (21–24). The screening device (31) is hinged for vertical swinging movement between a raised operating position and a lowered transport position. The conveyor mechanism (46) includes an elevating section (95) having a pair of hinged segments (103, 104) which are connected to the elevatable end of the screening device (31) so that both the hinged segments (103, 104) are raised and lowered between their operating and transport positions when the screening device (31) is moved by hydraulic actuators (121, 122) between its operating and transport positions. The main conveyor belt (48) passes rearwardly between the laterally spaced trailer wheels (21, 22 and 23, 24) with the working run being above and the return run being below the transverse wheel axles (73, 74). A receiving chute (47) for the main conveyor belt (48) is disposed rearwardly of the trailer main frame (11) and is mounted on a hinged section (79) of the conveyor (46) which is pivoted to the trailer main frame (11) adjacent the trailer wheels for swinging movement between a lowered operating position and a raised transport position.

16 Claims, 6 Drawing Figures

PORTABLE CRUSHING AND SCREENING PLANT

TECHNICAL FIELD

This invention relates to a portable crushing and screening plant having a crusher, a screening device and a conveyor which transports crushed material from the crusher to the input end of the screening device.

BACKGROUND OF THE PRIOR ART

Copending U.S. patent application of Larry D. Bronson and myself, Ser. No. 122,457, filed Feb. 19, 1980 on a Portable Crushing and Screening Plant, shows a screening device fed by a belt elevator which is foldable from an upright elevated operating position to a lowered, folded transport position by a first hydraulic power means and shows a screening device which is lowered from an elevated operating position to a lowered transport position by a second hydraulic power means. U.S. Pat. No. 3,439,806, Apr. 22, 1969, issued to R. A. Kass et al on a Portable Screening Plant shows a screening device pivoted at one end for swinging movement from a lowered transport position to an elevated operating position. The screening device in the Kass et al patent includes an underlying, inclined belt conveyor for receiving screened material. The inclined belt conveyor of the Kass et al patent has a first support frame fixedly secured to the screen frame and a second support frame hinged at one end to the first support frame and supported at its other end by a support link.

It is a primary object of the present invention to provide an improved portable crushing and screening plant, wherein an elevatable screen and a foldable elevator section of a belt conveyor are interconnected for simultaneous raising and lowering. It is also an object of the present invention to provide an improved belt conveyor apparatus in a portable crushing and screening plant.

BRIEF SUMMARY OF THE INVENTION

This invention may be usefully incorporated in a portable crushing and screening plant of the type having an elongated trailer main frame, laterally spaced wheels supporting the rear portion of the main frame, a crusher mounted on the rear portion of the main frame and a screening device disposed forwardly of the crusher with its support frame pivotally connected at its rear end to the main frame for vertical swinging movement about a transverse axis. The screening device feeds oversized material to the crusher and a conveyor mechanism feeds raw and crushed material to the screening device. The conveyor mechanism includes a vertically swingable section having its forward end pivotally connected to the main frame for pivotal movement about a transverse pivot axis adjacent the trailer wheels, a fixed position section secured in underslung relation to said main frame, and an elevating section at the front end of the trailer generally forward of the screening device. The elevating section of the conveyor includes an upwardly extending bottom segment having its lower end pivotally connected to the trailer main frame for vertical swinging movement about a transverse pivot axis between an upright operating position and a lowered transport position, a generally upright top segment pivotally connected at its lower end to the upper end of the bottom segment for vertically swinging movement between a raised operating position and a lowered transport position, and means connecting the segments to the supporting frame of the screening device so they are moved from their respective transport positions to their respective operating positions when the screening device is moved from its transport position to its operating position. Power means are provided on the trailer to move the screening device about its pivot connection with the main frame from its lowered transport position to its raised operating position, which movement causes simultaneous raising of the elevating section segments of the belt conveyor to their operating positions.

BRIEF DESCRIPTION OF THE DRAWINGS

The invention is illustrated in the drawings in which.

DETAILED DESCRIPTION OF THE INVENTION

Figure 1:
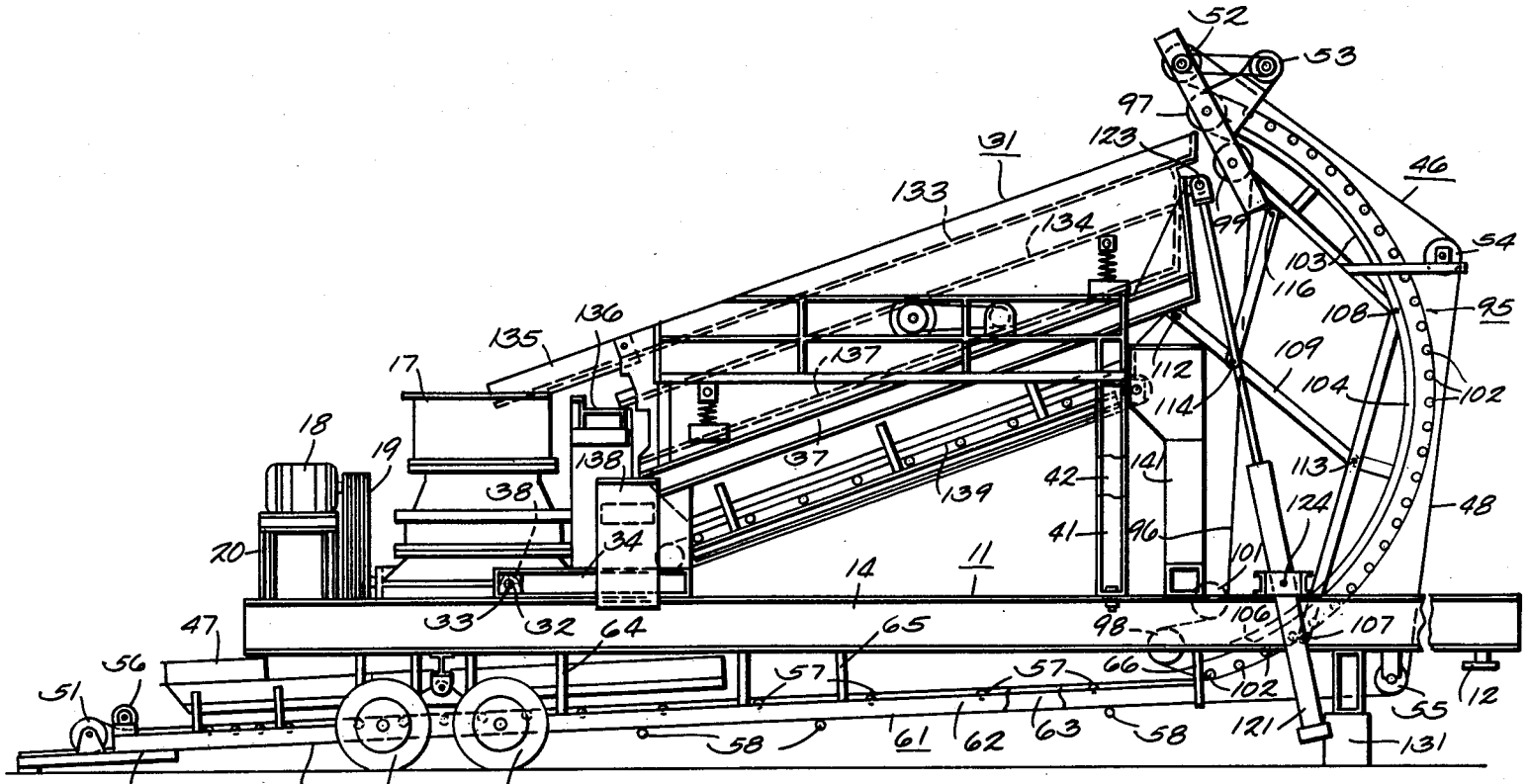
FIG. 1 is a side view of a portable crushing and screening plant in its operating mode.
Figure 2:
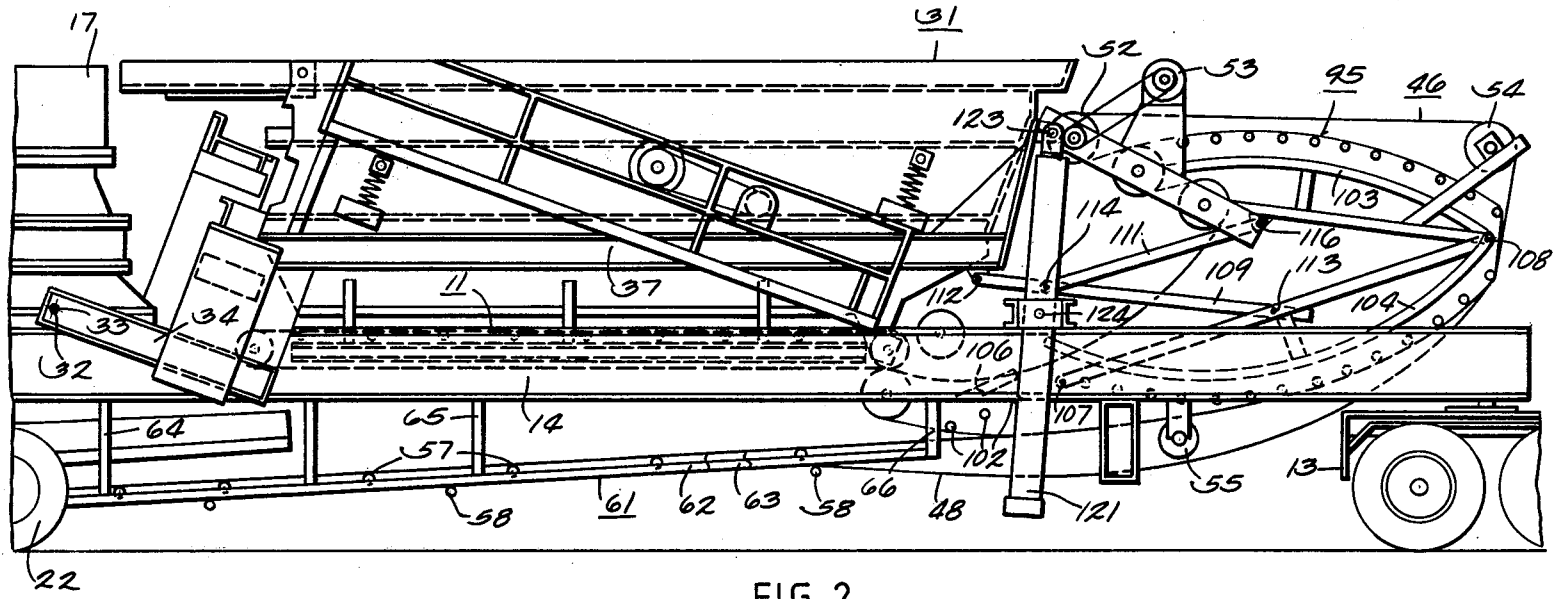
FIG. 2 is a side view of a portion of the plant, of FIG. 1 showing the plant in its transport mode.
Figure 3:
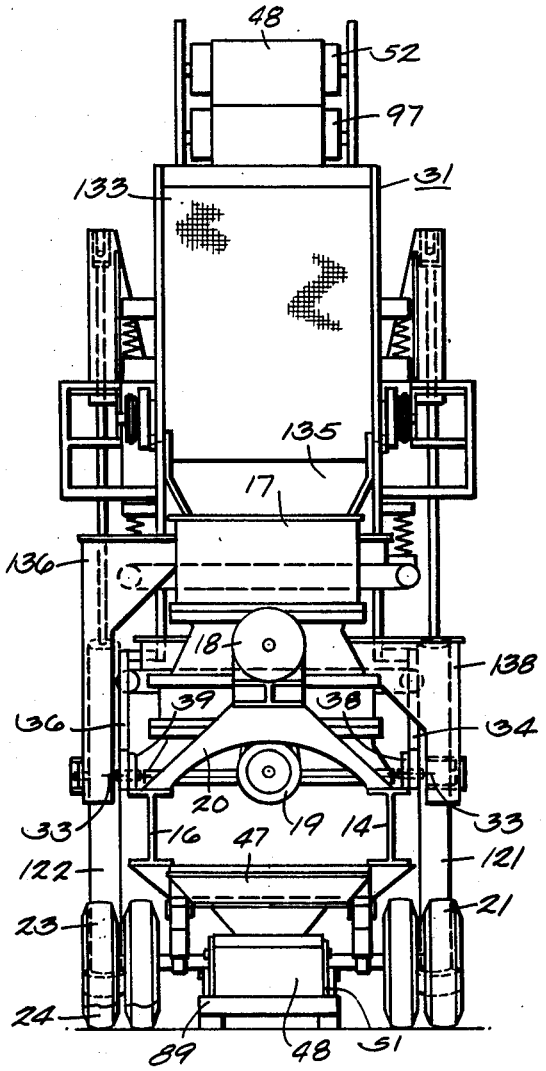
FIG. 3 is a rear end view of the plant shown in FIG. 1.

Referring to FIGS. 1, 2 and 3 of the drawings, the mobile, portable crushing and screening plant incorporating the present invention includes a trailer main frame 11 having a hitch part 12 at its front end adapted for connection to a towing vehicle 13, as shown in FIG. 2.

Figure 5:
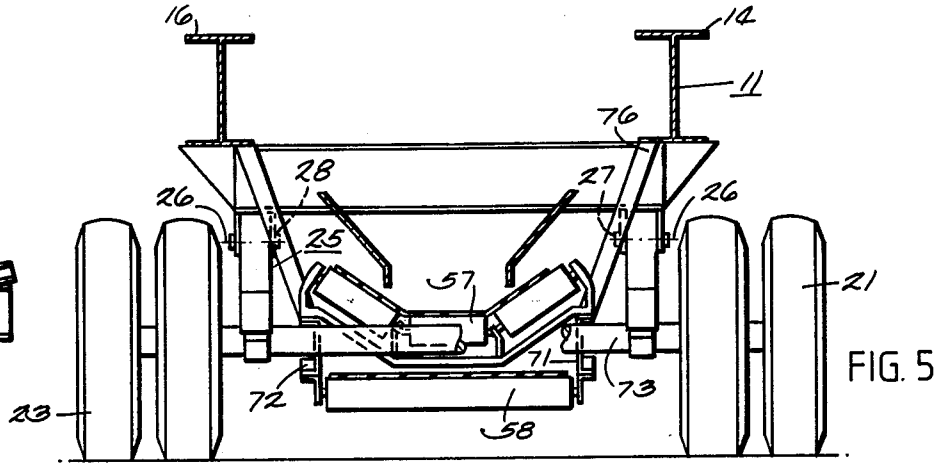
FIG. 5 is a view taken along the line V—V in FIG. 4.

The trailer main frame 11 includes a pair of parallel, longitudinally extending H-beams 14, 16 on which the major components of the crushing and screening plant are mounted. A cone crusher 17 is mounted on the rear portions of the H-beams 14, 16 and is driven by an electric motor 18 through a multiple V-belt drive mechanism 19. The motor 18, the support 20, and crusher 17 are located on the H-beams 14, 16 above the tandem mounted dual support wheel assemblies 21, 22, 23, 24. As shown in FIG. 5, the tandem axle structure 25 is pivotally mounted on the main frame 11 on a transverse pivot axis 26 by aligned pivot pins 27, 28.

Figure 4:
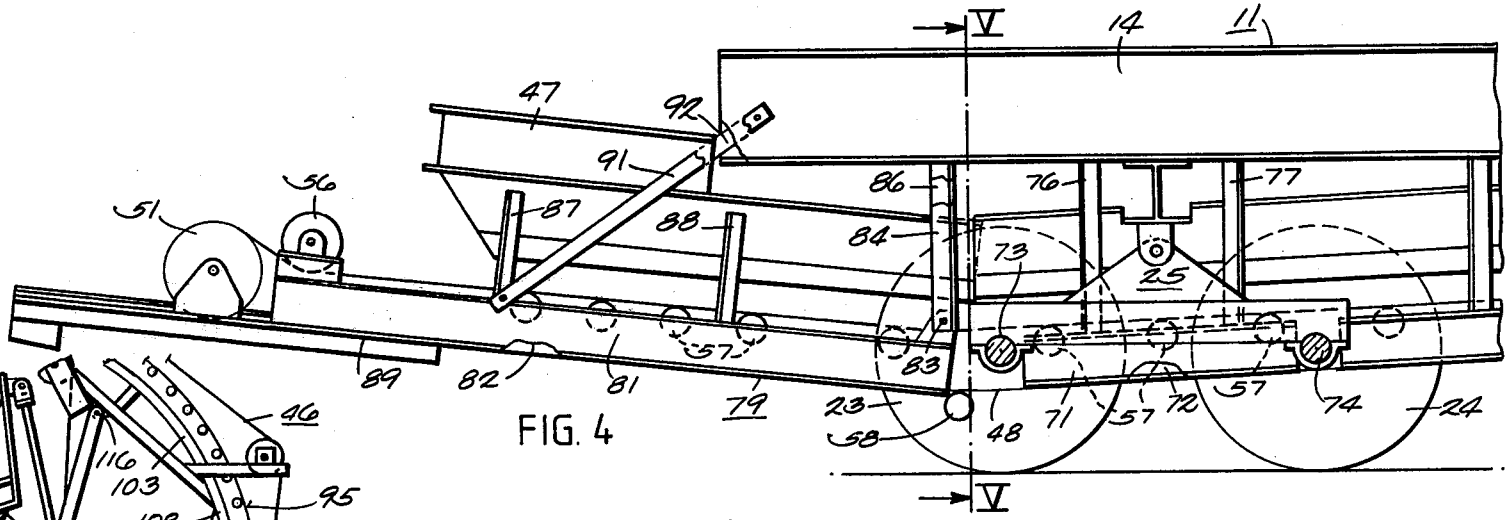
FIG. 4 is a side view of a rear portion of the plant showing the loading chute in a transport position.

A screening device in the form of a triple deck vibrating screen 31 has its rear end pivotally connected to the trailer frame 11 on a transverse pivot axis 32 by a pair of aligned pivot pins 33. The pins 33 pivotally connect rearwardly extending legs 34, 36 of the screen frame 37 to brackets 38, 39, respectively, welded to the top of the H-beams 14, 16 at laterally opposite sides of the crusher 17. The front end of the screen frame 37 is supported by a pair of removable posts 41, 42, when the plant is set up for operation at a work site, as shown in FIG. 1. A unique belt conveyor mechanism 46 is provided for the mobile plant to convey material to be processed from the receiving hopper 47 to the screen 31 and from the crusher 17 to the screen 31. The belt conveyor mechanism 46, in addition to the hopper 47, includes a relatively long endless belt 48 mounted on an end pulley 51, a drive pulley 52 driven by an electric motor 53 and idler pulleys 54, 55, 56. In the working run of the belt 48, it is supported by troughing roll assemblies 57 and in its return run, it is supported by return rollers 58. A conveyor support frame 61 for the belt 48 includes a generally horizontal fixed position section having a pair of parallel longitudinally extending channels 62, 63. Channel 62 is secured to the trailer frame H-beams 14 by hangers 64, 65, 66 which are welded at their upper and lower ends to the H-beam 14 and channel 62, respectively. The channel 63 is similarly fastened to the H-beam 16. As shown in FIG. 4, the fixed section of the conveyor includes a pair of short, parallel longitudinal channels 71, 72, disposed longitudinally between the wheel axles 73, 74 of the tandem axle structure 25, to which three troughing roll assemblies 57 are mounted. Channel 71 is stationarily secured to H-beam 14 by vertical straps or hangers 76, 77 welded at their upper ends to the H-beam 14 and at their lower ends to the channel 71. Channel 72 is similarly secured to H-beam 16.

The rear portion of the conveyor belt 48, the hopper 47, end rollers 51 and idler roller 56 are supported on a vertically swingable conveyor frame section 79 of the conveyor mechanism 46 which includes a pair of parallel channels 81, 82 the forward ends of which are pivotally connected on a transverse axis 83 to a pair of brackets 84, 86 welded to the H-beams 14, 16, respectively. The pivot connection between the vertically swingable conveyor frame section 79 and the trailer frame 11 is effected by aligned pivot pins interconnecting the lower ends of the brackets 84, 86 with upstanding brackets welded to the top front end of the channels 81, 82. The channels 81, 82 of the swingable frame section 79 carry a return roller 58, a plurality of troughing roll assemblies 57, and support the hopper through brackets 87, 88 at the left side of the hopper 47 and similar brackets, not shown, on the right side of the hopper 47. The end roller 51 is mounted on a subframe 89 secured as by welding to channels 81, 82. The end roller 51 is a take-up roller and thus is adjustably mounted on a track on the subframe by means, not shown, to permit selective adjustment of the tension of belt 48. A pair of detachable support hangers 91, 92 are used to support the pivoted section 79 of the conveyor 46 in the raised transport position, as shown in FIG. 4. The hangers are releasably secured to the H-beams 14, 16 and frame section 79 by suitable fasteners such as bolts and nuts. It will be noted the conveyor belt 48 is disposed laterally between the laterally spaced sets of dual wheel assemblies 21, 22 and 23, 24 with its upper working run passing above the transverse axles 73, 74 and the lower return run passing beneath the axles 73, 74.

The forward portion of the endless belt 48 cooperates with a second endless belt 96 in face-to-face manner to provide an elevating section 95 of the conveyor mechanism 46. The belt 96 is supported on end rollers 97, 98, idler rollers 99, 101 and troughing roll assemblies 102. The troughing roll assemblies 102 are mounted on support frame segments 103, 104 in the manner shown in U.S. Pat. No. 3,805,946. Three troughing roll assemblies 102 are secured to a mounting frame 106 rigidly secured to the trailer main frame 11 and constitute a part of the fixed frame section of the conveyor mechanism 46. The lower end of the bottom support frame segment 104 is pivotally connected to the trailer main frame 11 on a transverse axis 107 and the upper end of the frame segment 104 is pivotally connected to the bottom end of the upper support frame segment 103 on a transverse pivot axis 108. The frame segments 104, 103 are connected to the upper end of the screen frame 37 by a linkage which includes a main link 109 and a secondary link 111. This linkage causes the elevating section 95 of the conveyor mechanism 46 to be folded to a transport position, as shown in FIG. 2, when the screen 31 is lowered to its transport position. The main link 109 is pivotally connected at one end to the upper end of the screen frame 37 on a transverse axis 112 and at its other end to frame segment 104 on a transverse pivot axis 113. One end of the secondary link 111 is pivotally connected to an intermediate point of the main link 109 for pivotal movement about a transverse axis 114 and its other end is pivotally connected to the upper frame segment 103 on a transverse axis 116 at a point on the upper frame segment 103 spaced rearwardly of the folding axis 108. The linkage and frame segments 103, 104 to which connected constitutes a quadrilateral linkage. More specifically the link 11, the portion of segment 103 between axes 116 and 108, the portion of segment 104 between axes 108 and 113 and the portion of link 109 between axes 113 and 114 are of equal length thus effecting a quadrilateral linkage which is a true parallel linkage. It should be understood that a second linkage similar to links 109, 111 is disposed at the left side of the belt 96 and interconnects the screen frame 37 and elevating section frame segments 103, 104.

Figure 6:
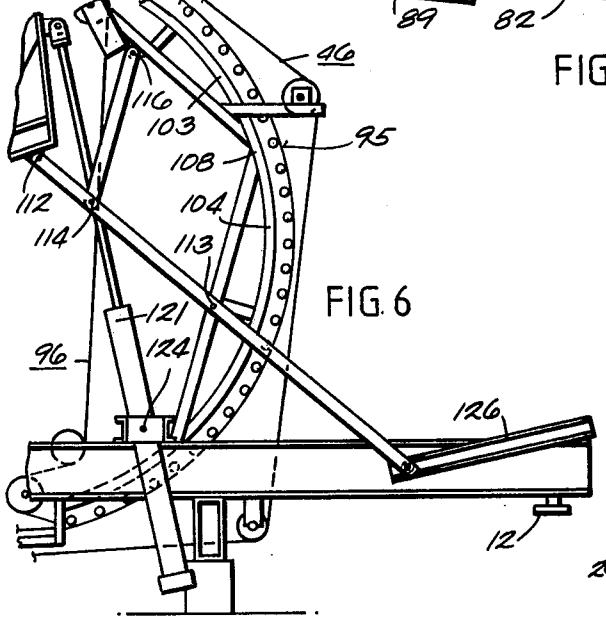
FIG. 6 is a partial side view of an alternate construction of the elevating section of the endless belt conveyor.

In the interest of strengthening the raising and lowering linkage, the main link 109 may be extended, as shown in FIG. 6, and provided with a roller which runs in a guide track 126 welded to the trailer main frame 11.

A pair of double-acting linear actuators in the form of laterally spaced, upright hydraulic jacks 121, 122 are provided to raise and lower the triple deck screen 31 about its transverse pivot axis 32. The rods ends of the jacks 121, 122 are pivotally connected to the upper front end of the screen frame 37 on a transverse pivot axis 123. The cylinders of the hydraulic jacks 121, 122 are pivotally connected to the trailer main frame 11 for pivotal movement about transverse axis 124.

OPERATION

As shown in FIG. 1, the portable crushing and screening plant is set up for operation. The trailer has been disconnected from the tow vehicle 13 and set on support blocks 131. Material to be processed is dumped into the hopper 47 and feeds by gravity onto the working run of conveyor belt 48 which conveys the material to the elevating section 95 of the conveyor mechanism 46 where the belt 48 and the material thereon is covered by the second belt 96. The material is discharged at the top of the belt elevator section 95 onto the top front of the vibrating screen 31. Oversize material too large to pass through the upper or first screen deck 133 passes to the top feeding, bottom discharging cone crusher 17 via a pivoted feed chute 135. Material passing through the openings in the upper screen deck 133, but which does not pass through the somewhat smaller openings of the second or intermediate screen deck 134, pass to a discharge chute 136 at the left side of the plant. Material passing through the openings in the secondary screen deck 134, but which is too large to pass through the somewhat smaller openings in the third or bottom screen deck 137, pass to a discharge chute 138 at the right side of the plant. Material passing through the openings of the lower screen deck 137 is conveyed by an endless belt conveyor 139 to a discharge chute 141 which discharges at the right side of the plant. Material crushed by the cone crusher 17 falls by gravity onto the working run of the belt 48 and is recycled to the triple deck vibrating screen along with any raw material being fed to the belt 48 by way of the receiving hopper 47.

When it is desired to move the plant to a different site, the support posts 41, 42, and the chute 141 are removed and the jacks 121, 122 are contracted. The triple deck screen 31 and the elevating section of the belt conveyor will fold to the lowered transport positions shown in FIG. 2 to provide lower overall height for transport by the towing vehicle 13 which is reattached to the trailer by way of hitch 12. The pivoted section 79 of the belt conveyor mechanism 46 is pivoted from its resting contact with the ground about the axis 83, which is near or adjacent axle 73, to a raised transport position, as shown in FIG. 4. A pair of support links 91, 92 are fastened to the trailer frame 11 and to the pivoted section 79 to releasably secure the latter in its raised transport position.

From the foregoing description, it is seen that by connecting one link of the quadrilateral linkage with the elevatable end of the screen 31, the actuators 121, 122 serve to raise and lower the elevating section 95 of the conveyor mechanism 46 as well as raise and lower the screen 31. Also, by passing the conveyor belt 48 laterally between the laterally spaced sets of dual wheels, and by providing a feeding hopper at the rear end, a very compact portable crushing and screening plant is achieved.

The embodiments of the invention in which an exclusive property or privilege are claimed is defined as follows:

1. In a portable crushing and screening plant including an elongated trailer main frame having a front portion and a rear portion, an axle structure mounting laterally spaced wheels supporting the rear portion of the main frame, a crusher mounted on the rear portion of the main frame and a screening device, characterized by, said screening device being disposed forwardly of said crusher and including a support frame pivotally connected at its rear end to said main frame for pivotal movement about a transverse axis between operating and transport positions, said screening device feeding oversize material to said crusher, an endless belt conveyor mechanism including a fixed position section secured to and beneath said main frame, and an elevating section at the front end of said main frame generally forward of said screening device including an upwardly extending bottom segment having its lower end pivotally connected to said main frame for vertical swinging movement about a transverse pivot axis between an upright operating position and a lowered transport position, a generally upright top segment pivotally connected at its lower end to the upper end of said bottom segment for vertical swinging movement between a raised operating position and a lowered transport position, and means connecting said segments to said support frame of said screening device whereby said segments are moved from their respective transport positions to their respective operating positions when said screening device is moved from its transport position to its operating position, and power means operatively interposed between said trailer main frame and said screening device operable to move said screening device about its pivot connection with said main frame from its lowered transport position to its raised operating position.

2. The combination of claim 1 wherein said means connecting said segments of said elevating section to said support frame of said screening device includes a pair of links interconnected to one another and, respectively, to said segments to form a quadrilateral linkage.

3. The combination of claim 2 wherein said quadrilateral linkage is a parallel linkage.

4. The combination of claim 1 wherein said means connecting said segments to said support frame of said screening device includes a main link having one of its ends pivotally connected to said support frame and a portion spaced from said one end pivotally connected to said lower segment at a point spaced below said pivot connection between said segments and a secondary link pivotally connected at one end to said main link intermediate the latter's connections to said support frame and said lower segment and at its other end to said upper segment at a point spaced above the pivot connection between said segments.

5. The combination of claim 4 wherein said main link has a lower end supported on a longitudinally extending track.

6. The combination of claim 1 wherein said conveyor mechanism includes a vertically swingable longitudinally extending section pivotally connected at its front end to said trailer main frame on a transverse pivot axis rearwardly of said axle structure.

7. The combination of claim 6 wherein said vertically swingable section includes a hopper for receiving material to be processed by said portable plant.

8. In a portable crushing and screening plant including an elongated trailer main frame having a front portion and a rear portion, an axle structure having laterally spaced wheels mounted thereon operatively supporting the rear portion of the main frame, a crusher mounted on the rear portion of the main frame and a screening device, characterized by, said screening device being disposed forwardly of said crusher and including a support frame pivotally connected at its rear end to said main frame for vertical swinging movement about a transverse axis between a raised operating position and a lowered transport position, said screening device feeding oversize material to said crusher, an endless belt conveyor mechanism mounted on said trailer main frame including a longitudinally extending portion in underlying relation to said main frame, an elevating section at said front portion of said trailer main frame including an upwardly extending bottom segment having its lower end pivotally connected to said main frame for vertical swinging movement about a transverse pivot axis between an upright operating position and a lowered transport position, a generally upright top segment pivotally connected at its lower end to the upper end of said bottom segment for vertical swinging movement between a raised operating position and a lowered transport position, and means connecting said segments to said support frame of said screening device whereby said segments are moved from their respective transport positions to their respective operating positions when said screening device is moved from its transport position to its operating position, power means operatively interposed between said trailer main frame and said screening device operable to move said screening device about its pivot connection with said main frame from its lowered transport position to its raised operating position, a first endless conveyor belt operatively supported on said longitudinal portion and elevating section having the rear portion of its working run in receiving relation to the output from said crusher, and a second endless belt operatively supported on said elevating section having face-to-face contact with a portion of the working run of said first belt, said belts being operable to elevate material being processed in said plant to said screening device.

9. The plant of claim 8 wherein said longitudinal portion of said conveyor mechanism includes a rear section carrying said rear portion of said first belt, said rear section being pivotally connected at its forward end to said trailer main frame and extending rearwardly of said support wheels whereby raw material to be processed by the plant may be initially received by the working run of said first belt.

10. The plant of claim 9 wherein said longitudinal portion of said conveyor mechanism includes a longitudinally extended section fixedly secured in underlying relation to said trailer main frame, said longitudinal portion extending rearwardly between said laterally spaced wheels.

11. The plant of claim 10 wherein said wheel structure includes at least one axle for said laterally spaced wheels and said first belt includes a return run, said working run of said first belt passing above said axle and said return run of said first belt passing beneath said axle.

12. The plant of claim 10 and further comprising a receiving hopper at the rear of said main frame for receiving raw material to be processed and discharging said raw material onto the working run of said first belt supported on said rear section.

13. The plant of claim 12 wherein said hopper is mounted on said rear section and said rear section is swingable between a lowered operating position and a raised transport position.

14. The plant of claim 8 wherein said means connecting said segments to said support frame of said screening device includes a quadrilateral linkage operable to fold said segments from their raised upright positions to their lowered, generally horizontal positions when said power means lowers said screening device from its raised operating position to it lowered transport position.

15. The plant of claim 8 wherein said means connecting said segments to said support frame of said screening device includes a main link having one of its ends pivotally connected to said support frame and a portion spaced from said one end pivotally connected to said lower segment at a point spaced below said pivot connection between said segments and a secondary link pivotally connected at one end to said main link intermediate the latter's connections to said support frame and said lower segment and at its other end to said upper segment at a point spaced above the pivot connection between said segments.

16. The plant of claim 8 wherein said support frame for said screening device includes a pair of rearwardly extending legs pivotally connected to said trailer main frame at laterally opposite sides of said crusher for pivotal movement about said transverse axis.

* * * * *